US007810194B2

(12) United States Patent
Clenet

(10) Patent No.: US 7,810,194 B2
(45) Date of Patent: Oct. 12, 2010

(54) MATTRESS FOR ADJUSTABLE BED

(76) Inventor: Alain Clenet, 56 Castillian, Suite 148, Goleta, CA (US) 93117

( * ) Notice: Subject to any disclaimer, the term of this patent is extended or adjusted under 35 U.S.C. 154(b) by 0 days.

(21) Appl. No.: 12/082,084

(22) Filed: Apr. 7, 2008

(65) Prior Publication Data

US 2008/0263775 A1 Oct. 30, 2008

Related U.S. Application Data

(60) Provisional application No. 60/922,122, filed on Apr. 5, 2007.

(51) Int. Cl.
*A47C 17/00* (2006.01)

(52) U.S. Cl. ..... 5/694; 5/701; 5/659

(58) Field of Classification Search ..... 5/726, 5/727, 724, 722, 613, 640, 643, 701, 694, 5/730, 704, 904, 652.2, 611, 729, 284, 421, 5/423, 618, 723, 658, 659
See application file for complete search history.

(56) References Cited

U.S. PATENT DOCUMENTS 2,995,762 A * 8/1961 Albinson ..... 5/485
3,447,170 A * 6/1969 Spitz ..... 5/618
4,336,621 A * 6/1982 Schwartz et al. ..... 5/722
4,437,702 A * 3/1984 Agosta ..... 5/248
4,841,587 A * 6/1989 Carter et al. ..... 5/419
4,899,404 A * 2/1990 Galumbeck ..... 5/616
5,335,381 A * 8/1994 Chang ..... 5/423
7,047,579 B2 * 5/2006 Piana et al. ..... 5/618
2005/0039265 A1 * 2/2005 Gladney ..... 5/722

* cited by examiner

*Primary Examiner*—Robert G Santos
*Assistant Examiner*—Brittany M Wilson
(74) *Attorney, Agent, or Firm*—Felix L. Fischer

(57) ABSTRACT

A mattress for use with an adjustable bed frame having a carriage, a head support section and a thigh support section connected to the carriage and a foot support section connected to the thigh support section includes a foam layer, a rigid planar retainer member fastened to an underside portion of the foam layer, a fabric layer arranged to cover the retainer member and a fastener connected to the retainer member for connecting the retainer member to the carriage. The mattress may include a plurality of channels formed in the foam layer and arranged to allow airflow through the foam layer. A fan may be mounted in the foam layer to force air through the channels. Loudspeaker system components may also be mounted in the channels.

11 Claims, 6 Drawing Sheets

MATTRESS FOR ADJUSTABLE BED

CROSS REFERENCE TO RELATED APPLICATION

Priority is claimed based on U.S. Provisional Application 60/922122 filed Apr. 5, 2007.

BACKGROUND OF THE INVENTION

This invention relates generally to mattresses and particularly to mattresses for use with adjustable bed frames.

Prior mattresses typically exhibit a "bridging effect" when an adjustable bed frame is arranged so that the head and foot support sections are elevated. The mattress rises above the carriage and causes difficulty in using the adjustable features of the bed frame to place the mattress in a desired position.

SUMMARY OF THE INVENTION

A mattress according to the present invention for use with an adjustable bed frame having a carriage, a head support section and a thigh support section connected to the carriage and a foot support section connected to the thigh support section comprise a foam layer; a rigid planar retainer member fastened to an underside portion of the foam layer; a fabric layer arranged to cover the retainer member; and apparatus connected to the retainer member for fastening the retainer member to the carriage.

The mattress according to the present invention preferably has a plurality of channels formed in the foam layer and arranged to allow airflow through the foam layer. A fan may be mounted in the foam layer to force air through the channels. Loudspeaker system components may also be mounted in the channels,

DETAILED DESCRIPTION OF THE INVENTION

Figure 1:
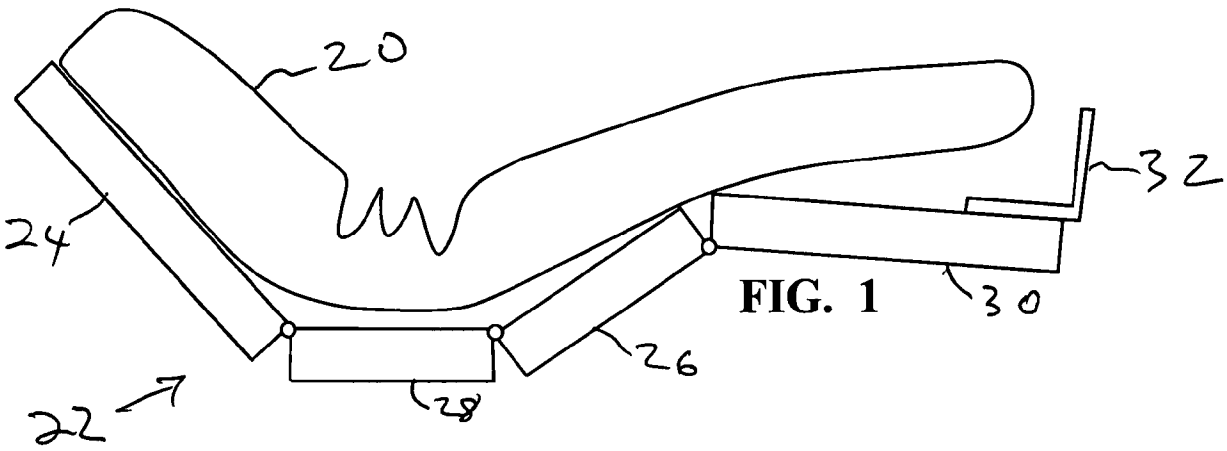
FIG. 1 is an elevation view showing the bridging effect that typically occurs with prior art mattresses.

Referring to FIG. 1, a conventional mattress 20 is placed upon a typical adjustable bed frame 22 having a head support section 24 and a thigh support section 26 hingedly connected to opposite sides of a carriage 28. A foot support section 30 is attached to the thigh support section. Such bed frames typically include a mattress retainer 32 at the end of the foot support section 30 to prevent the mattress 20 from sliding off the frame 22 as it is adjusted from one position to another. Raising the head support section 24 and the thigh support section 26 causes the mattress to rise above the carriage 28.

Figure 2:
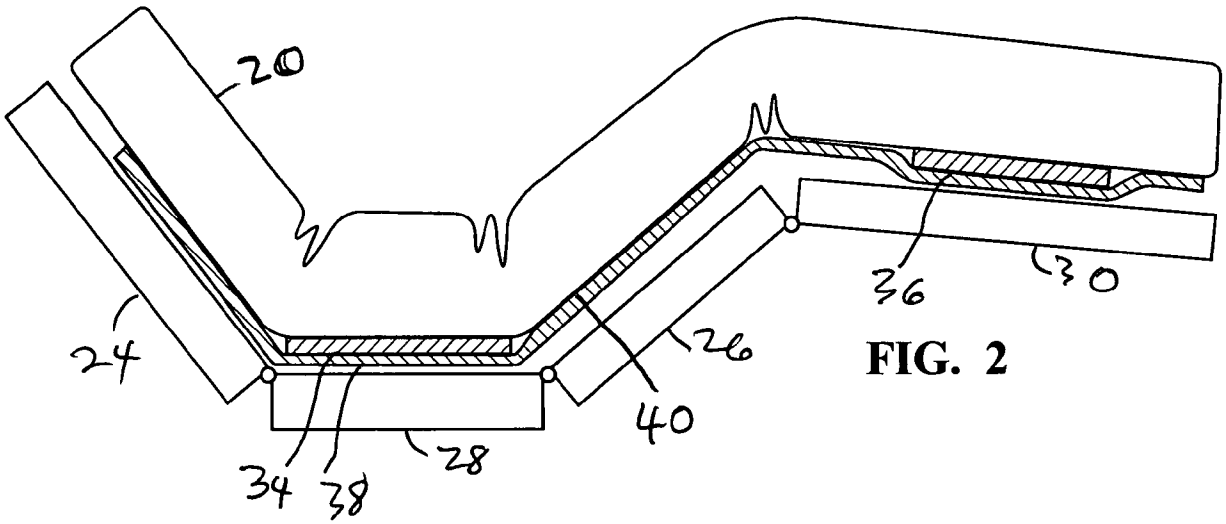
FIG. 2 shows the desired configuration of mattress when the head and foot sections are elevated.
Figure 4:
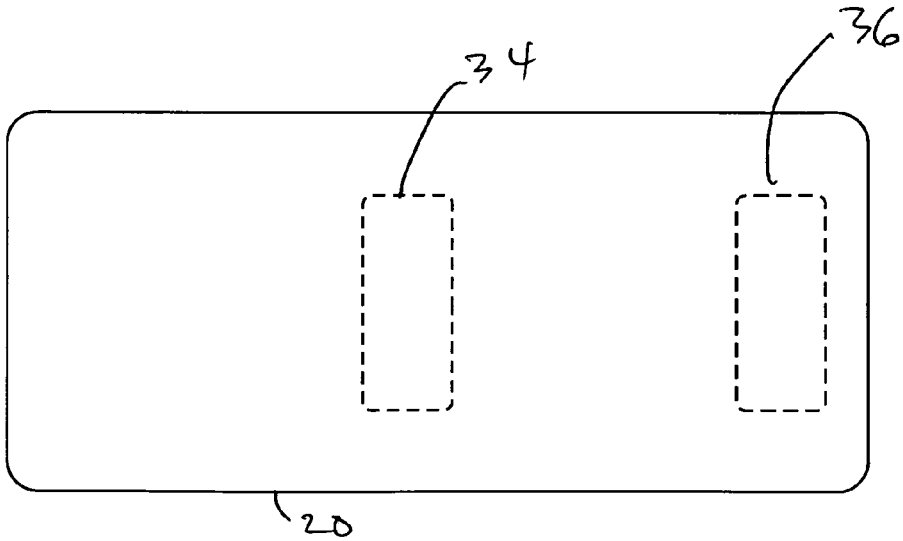
FIG. 4 shows suitable locations for connected the mattress of FIG. 3 to a frame.

FIGS. 2 and 4 show a first board 34 connected to the mattress 20 above the carriage 28 and a second board 36 mounted to the mattress above the foot support section 30. A fabric layer 38 covers the boards 34 and 36 and essentially the entire bottom side 40 of the mattress 20.

Figure 3:
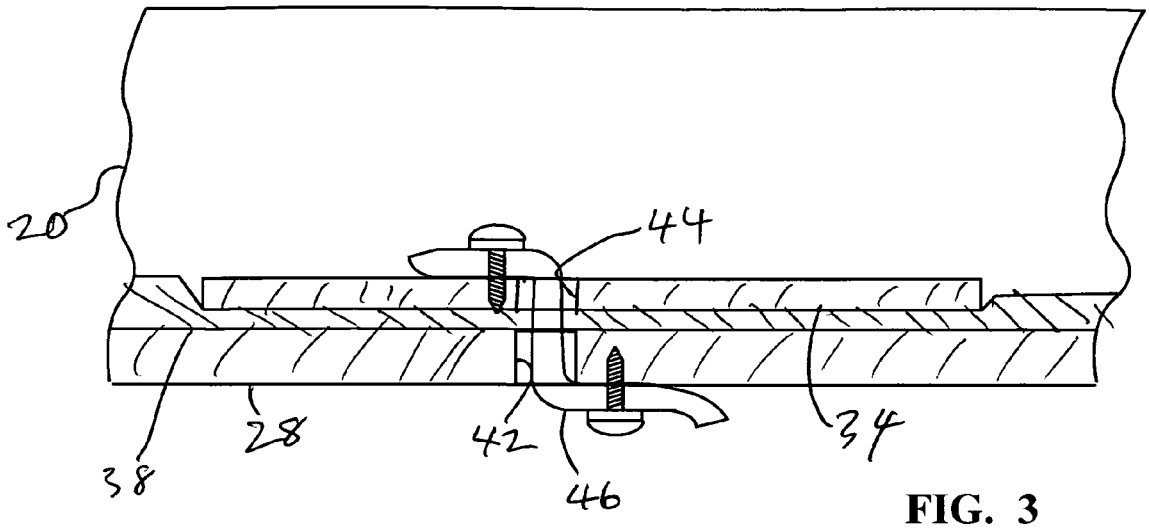
FIG. 3 shows a mattress connected to an underlying frame.

FIG. 3 shows apparatus for connecting the mattress to the carriage 28. A passage 42 is formed in the base platform that comprises the carriage 28 and a passage 44 is formed in the board 34. A strap 46 is fastened to the bottom side carriage using any suitable fastening means such as nails or screws. The strap passes through the passages 42 and 44 and is also fastened to the topside of the board 34.

Figure 5:
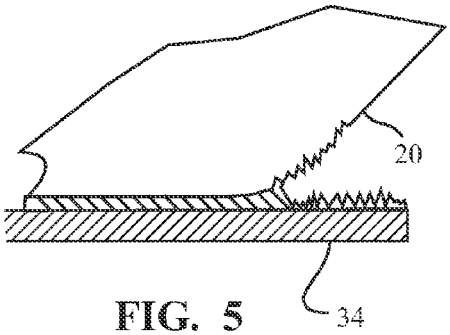
FIG. 5 shows a problem that occurs when a mattress is connected to a frame using only an adhesive.

FIG. 5 illustrates a problem that occurs if the mattress 20 is merely glued to the board 34. Flexing the mattress 20 causes a portion of it to pull away from the board. Complete separation is likely to occur eventually.

Figure 6:
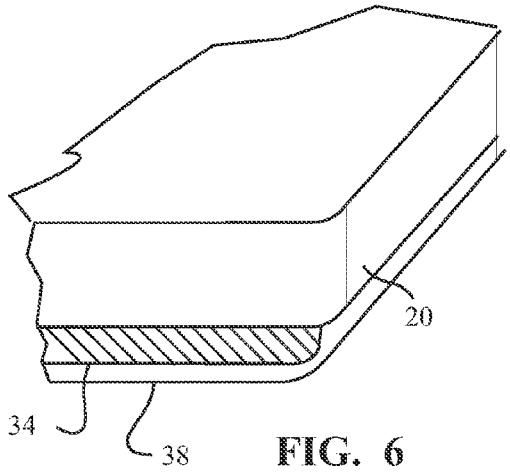
FIG. 6 shows a portion of a mattress connected to a board that is then covered with a layer of a fabric.

FIG. 6 shows the fabric 38 fastened to the mattress 20 and to the board 34. The fabric provides a shear-resistant force that prevents the mattress 20 from peeling away from the board 34.

Figure 7:
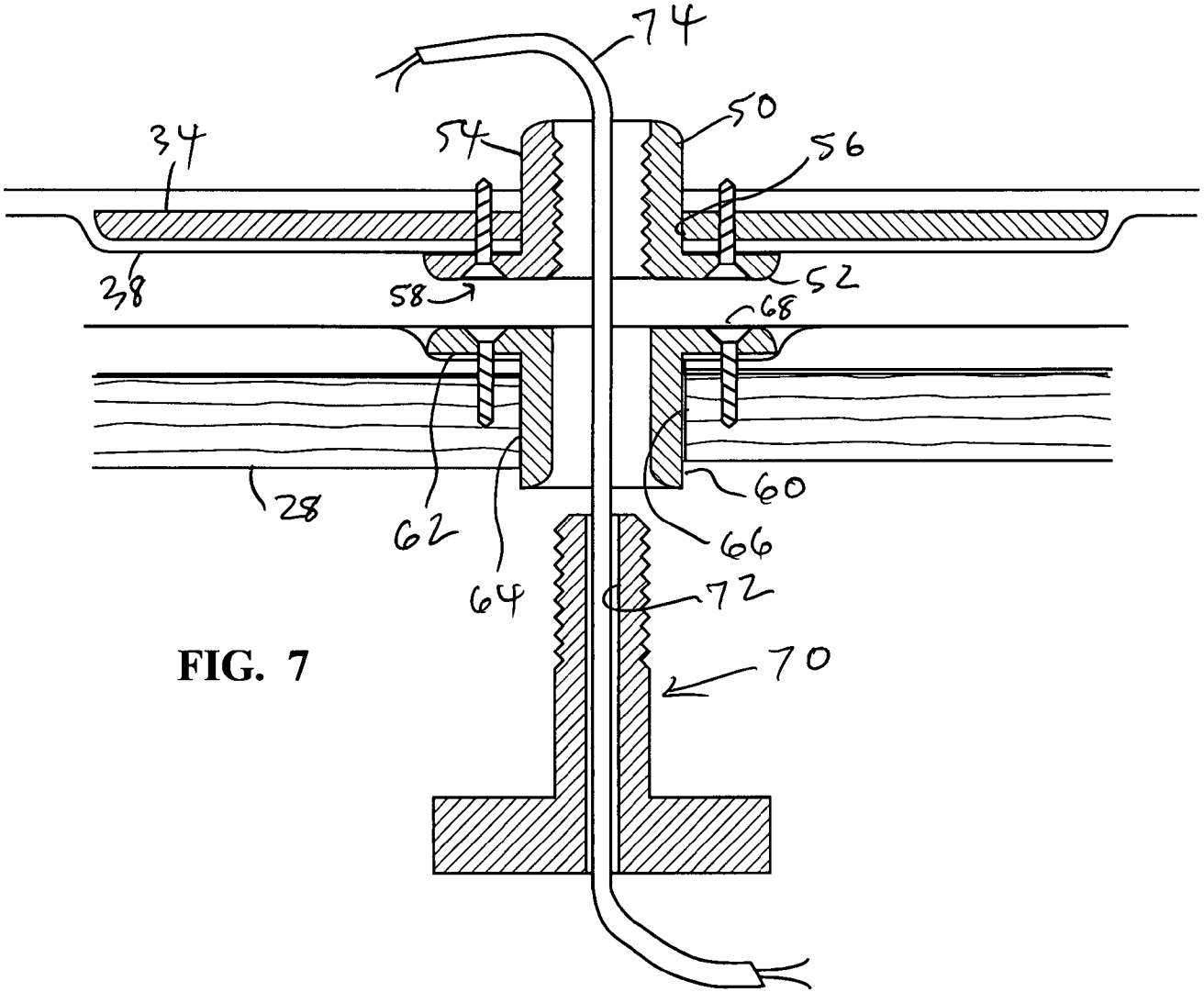
FIG. 7 shows apparatus for connected a mattress to a board and having a passage for loudspeaker wires.
Figure 8:
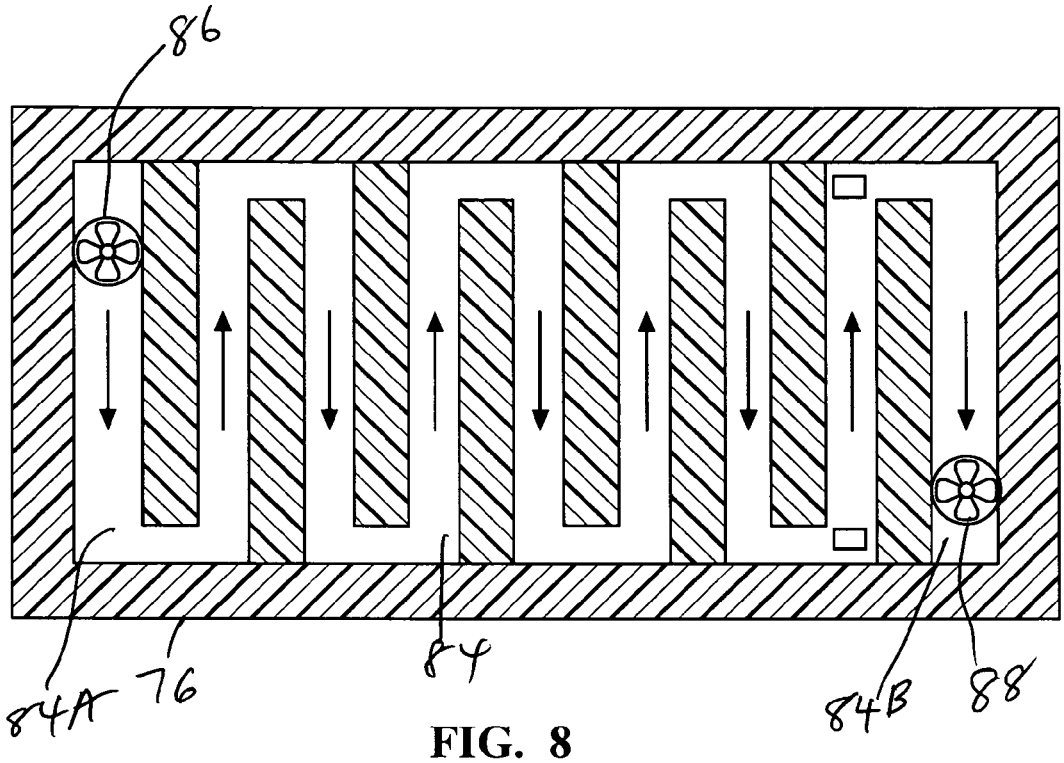
FIG. 8 is a horizontal cross sectional view showing a mattress having air passages, an input fan and an exhaust fan and loudspeakers installed in the air passages.

Referring to FIG. 7, the board 34 may be connected to the carriage 28 using a nut 50 that has a flange 52 at one end. The nut 50 is has an elongate cylindrical threaded portion 54 that passes through a passage 56 in the board 28. Screws 58 or other suitable fasteners secure the flange 52 to the bottom side of the board 34. A bushing 60 having a flange 62 has a cylindrical portion 64 that passes through a passage 66 in the carriage 28. Screws 68 or other suitable fasteners secure the flange 62 to the topside of the carriage 28. A hollow bolt 70 extends through the bushing and is then threaded engaged with the nut 50. The bolt 70 has a lengthwise passage 72 that may by used to pass speaker wiring 74 through the carriage 28 and the board 34 to speakers mounted inside the mattress 20.

FIGS. 8-11 show a mattress 76 formed to have a central foam portion 78, a top layer 80 that is preferably formed of a viscoelastic material, a bottom layer 82 and side and end layers. The central portion 80 has a plurality of passages 84 therein that are preferably generally perpendicular to the longitudinal axis of the mattress 76. The passages 84 are arranged so that there is fluid communication between adjacent passages. A fan 86 is mounted inside a passage 84A at the foot end of the mattress 76, and a similar fan 88 is mounted in a passage 84B at the head of the mattress 76. The fans 86 and 88 may be of a type that is prevalent in small computers. The fan 86 may be arranged to blow air into the passages 84 while the fan 88 is arranged to function in an exhaust mode. Air flow through the mattress 76 aids in keeping the mattress at a uniform temperature, which has been found to provide increased comfort to a person using the mattress.

Figure 10:
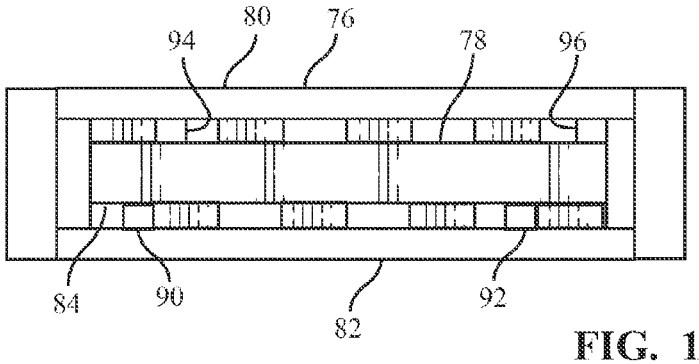
FIG. 10 is an end view of the mattress of FIGS. 8 and 9.
Figure 11:
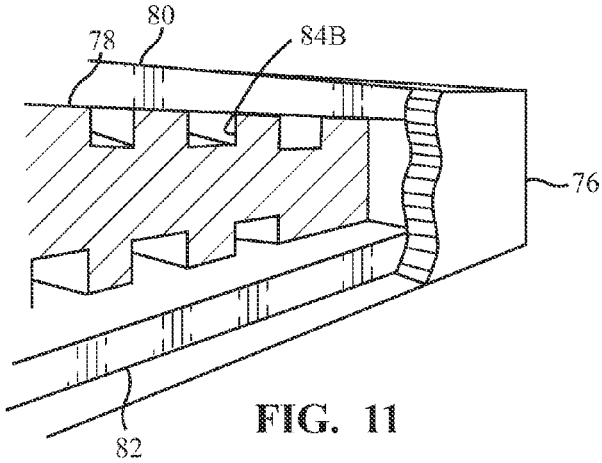
FIG. 11 is a partial cutaway perspective view of the mattress of FIGS. 8, 9 and 10.
Figure 9:
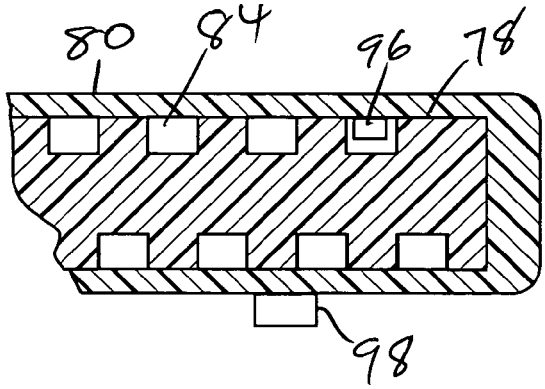
FIG. 9 is a partial vertical cross sectional view of the apparatus of FIG. 8 showing placement of tweeter and woofer loudspeakers

Referring to FIG. 10, massage motors 90 and 92 and speakers 94 and 96 may also be mounted in the passages 84. FIG. 9 shows a suitable location for a woofer 98 that may be included in the speaker system.

Figure 12:
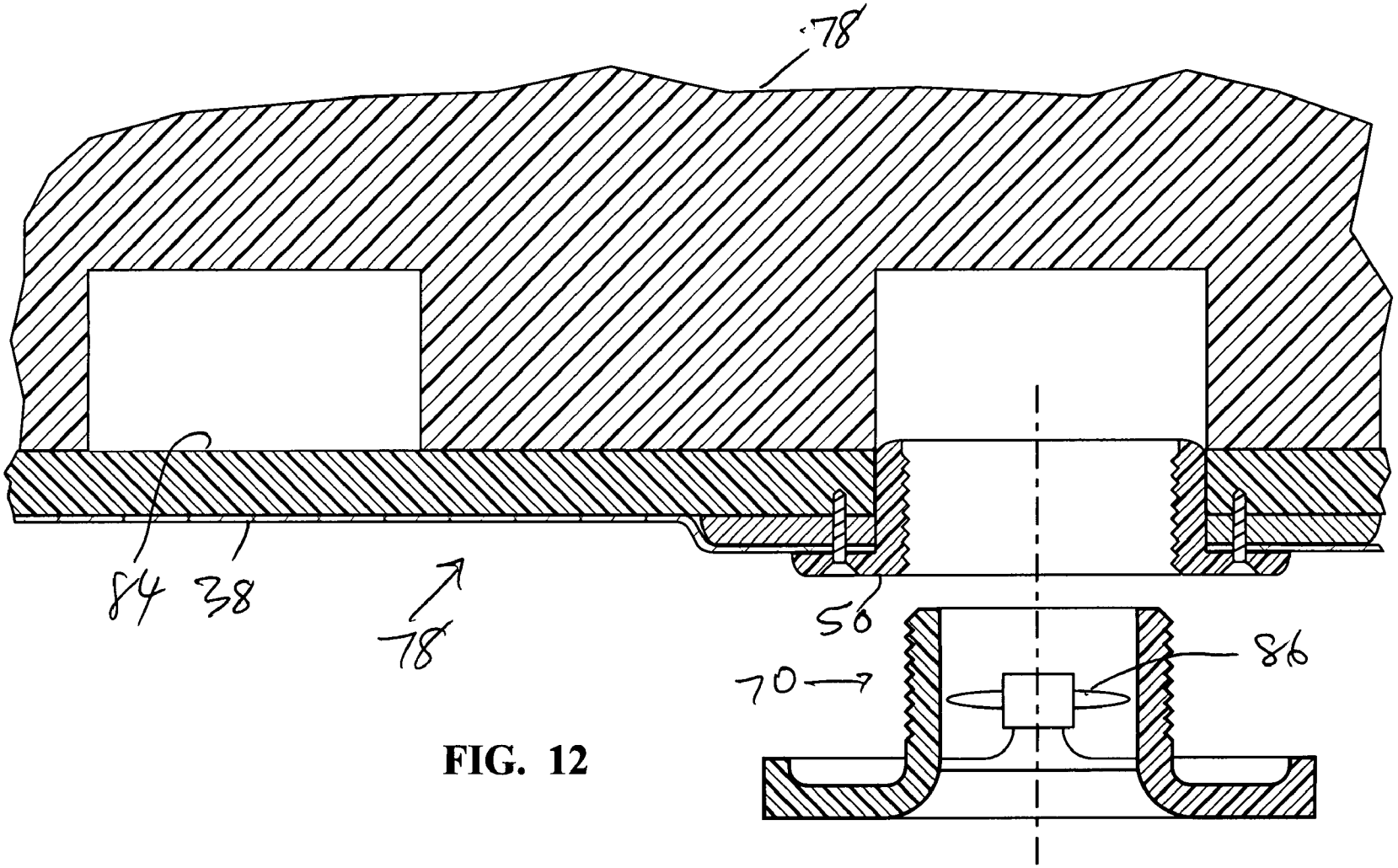
FIG. 12 shows apparatus for mounting a fan to a mattress

FIG. 12 shows apparatus that is essentially the same as that of FIG. 7 with the differences being the omission of the bushing 60 and making the passage 72 have a diameter large enough to mount the fans 86 and 88 to the mattress 76.

What is claimed is:

1. A mattress for use with an adjustable bed frame having a carriage, a head support section and a thigh support section connected to the carriage and a foot support section connected to the thigh support section, comprising:

a foam layer having an bottom side;

at least one rigid planar retainer member fastened to a portion of the bottom side of the foam layer adjacent and attached directly to the carriage;

a fabric layer fastened to the bottom side of the foam layer and extending on either side of the portion of the bottom side to which the at least one retainer member is fastened, the at least one retainer member adhered intermediate the fabric layer and said portion of the bottom side; and apparatus connected to the retainer member for fastening the retainer member to the carriage.

2. The mattress of claim 1 wherein a plurality of channels are formed in the foam layer and arranged to allow air flow through the foam layer.

3. The mattress of claim 2 further comprising a fan mounted in the foam layer to force air through the channels.

4. The mattress of claim 2 wherein loudspeaker system components are mounted in the channels.

5. The mattress as defined in claim 1 wherein the at least one retainer member comprises a first retainer member adhered to a first portion of the bottom side of the foam layer above a carriage of the bed frame and a second retainer member adhered to a second portion of the bottom side of the foam layer above a foot support section, wherein the fabric layer is fastened to the underside of the foam layer extending on either side of both the first portion and second portion, said first and second retainer members adhered intermediate the fabric layer and the first and second portions of the bottom side.

6. The mattress as defined in claim 5 wherein the fabric layer covers essentially the entire bottom side of the foam layer.

7. The mattress as defined in claim 1 wherein the apparatus connected to the at least one retainer member comprises:

a strap extending through an aperture in the at least one retainer member and the fabric layer and fastened to a top side of the retainer member, said strap extending oppositely through an aperture in the carriage and fastened to a bottom side thereof.

8. The mattress as defined in claim 1 wherein the apparatus connected to the at least one retainer member comprises:

a nut extending through a passage in the at least one retainer member and fabric layer;

a bushing extending through a passage in the carriage; and, a bolt extending through the bushing and threadedly engaging the nut to secure the at least one retainer member to the carriage.

9. The mattress as defined in claim 8 wherein the nut incorporates a threaded cylindrical portion extending through the passage in the at least one retainer member and a flange, said flange secured to the at least one retainer member;

wherein the bushing incorporates a cylindrical portion extending through the passage in the carriage and a flange, said flange secured to the carriage; and wherein the bolt contains a passage.

10. The mattress as defined in claim 9 wherein a plurality of channels are formed in the foam layer and arranged to allow air flow through the foam layer and further comprising a fan mounted in the passage in the bolt to force air through the channels.

11. A mattress for use with an adjustable bed frame comprising:

a foam layer having an bottom side;

a first retainer member adhered to a first portion of the bottom side of the foam layer above and attached directly to a carriage of the bed frame and a second retainer member adhered to a second portion of the bottom side of the foam layer above and attached directly to a foot support section of the bed frame;

a fabric layer fastened to the underside of the foam layer extending on either side of both the first portion and second portion, said first and second retainer members adhered intermediate the fabric layer and the first and second portions of the bottom side.

* * * * *